166-291
10/22/85 OR 4,548,271

United States Patent [19]
Keller

[11] Patent Number: 4,548,271
[45] Date of Patent: Oct. 22, 1985

[54] OSCILLATORY FLOW METHOD FOR IMPROVED WELL CEMENTING

[75] Inventor: Stuart R. Keller, Houston, Tex.

[73] Assignee: Exxon Production Research Co., Houston, Tex.

[21] Appl. No.: 540,065

[22] Filed: Oct. 7, 1983

[51] Int. Cl.[4] ..... E21B 33/16
[52] U.S. Cl. ..... 166/291; 166/285; 166/328
[58] Field of Search ..... 166/285, 291

[56] References Cited

U.S. PATENT DOCUMENTS

| | | | |
|---|---|---|---|
| 1,563,520 | 12/1925 | Owen | 166/285 |
| 1,647,003 | 10/1927 | Huber | 166/285 |
| 2,675,082 | 4/1954 | Hall | 166/285 |
| 3,086,592 | 4/1963 | Hoch | 166/291 X |
| 3,411,580 | 11/1968 | McKinney et al. | 166/285 |
| 3,412,795 | 11/1968 | Terry | 166/285 |

FOREIGN PATENT DOCUMENTS

| | | | |
|---|---|---|---|
| 571584 | 9/1977 | U.S.S.R. | 166/285 |

OTHER PUBLICATIONS

Haut et al., "Primary Cementing: Optimizing for Maximum Displacement", *World Oil*, Nov. 1980, pp. 105–116.

*Primary Examiner*—George A. Suchfield
*Attorney, Agent, or Firm*—Kenneth C. Johnson

[57] ABSTRACT

The present invention is a method for improving well cementing. A fluid such as drilling mud or preflush fluid is oscillated in the annulus prior to introduction of cement slurry into the annular interval to be cemented. The fluid is oscillated by changing its direction of flow at least twice. The oscillatory flow of the fluid flushes gelled drilling mud and filter cake from the annulus more effectively than conventional unidirectional flow. Following the oscillatory phase, cement slurry is pumped into the annular interval to be cemented, thus displacing the fluid, and is allowed to set. The fluid can be oscillated in the annulus either before or after the cement slurry is introduced into the casing. A selective check valve is also described which permits all fluids to flow in the forward direction out of the casing and into the annulus and which permits all fluids other than cement slurry to flow in the reverse direction out of the annulus and into the casing.

13 Claims, 3 Drawing Figures

FIG. 2
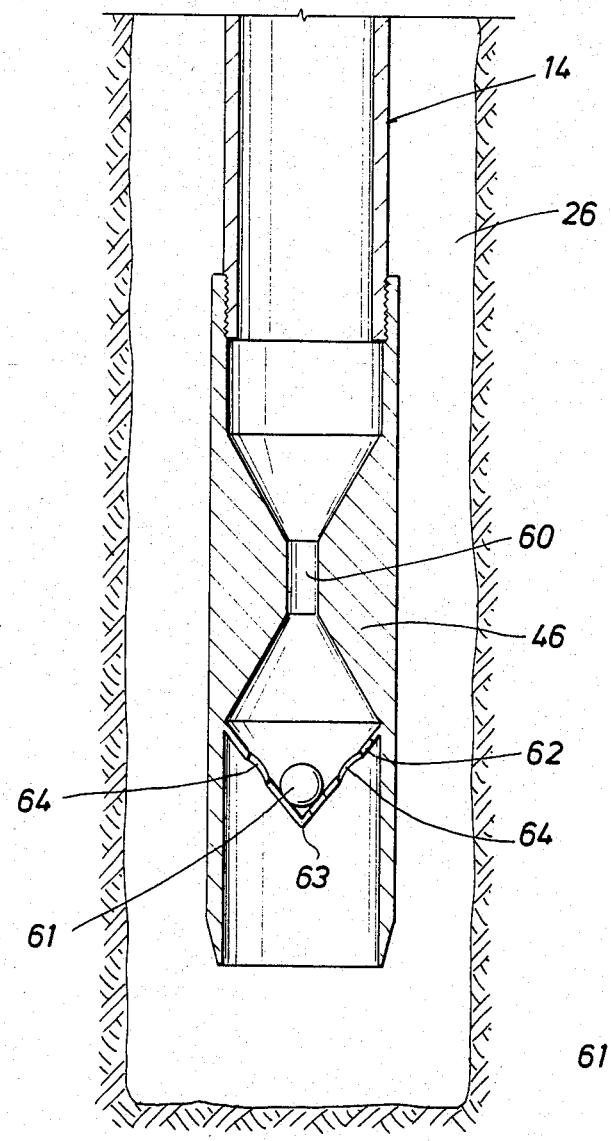
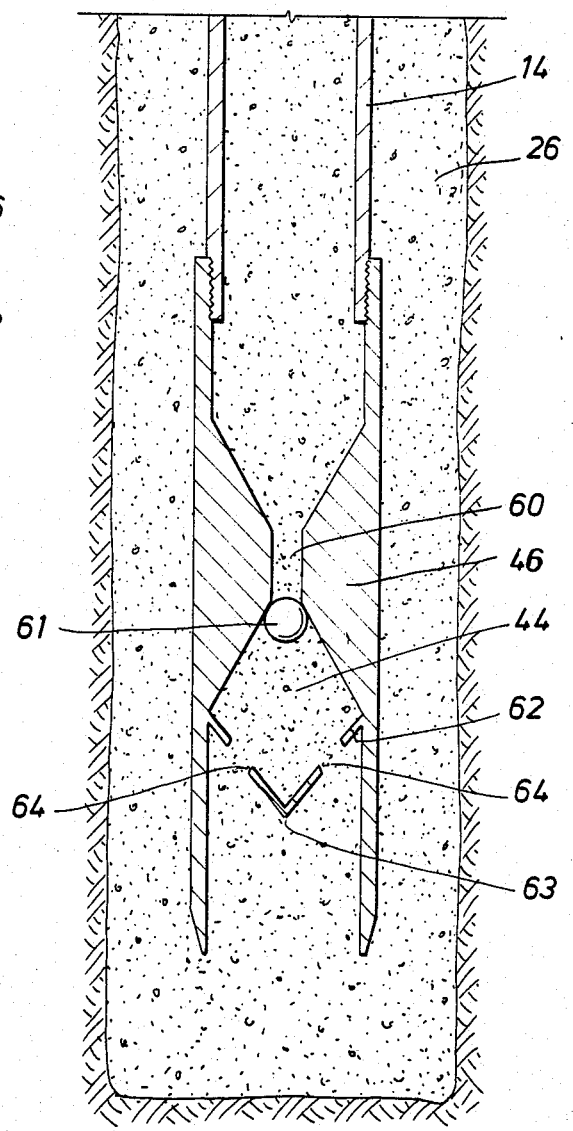
FIG. 3

OSCILLATORY FLOW METHOD FOR IMPROVED WELL CEMENTING

FIELD OF THE INVENTION

The present invention relates to the cementing of wells. More particularly, the present invention relates to a method for removing drilling mud and filter cake from the annulus of a well to achieve improved cementing.

BACKGROUND OF THE INVENTION

In the drilling of oil and gas wells, drilling mud is circulated down the interior of a hollow drill string, through nozzles in a drill bit located at the bottom of the drill string, and back up to the surface through the space between the drill string and the wall of the wellbore. The drilling mud is typically either water-base or oil-base and contains a variety of components. The primary functions of the drilling mud are to lubricate the drill bit, to transport rock cuttings to the surface and to maintain a hydrostatic pressure in the wellbore sufficient to prevent the intrusion of formation fluids and thereby prevent blowouts.

Following drilling, casing is cemented in the wellbore to prevent caving in of the hole and to segregate the formations penetrated. A casing string is lowered into the wellbore and a cement slurry is pumped into the annulus between the casing and the wall of the wellbore. This is usually accomplished by pumping the cement slurry downward through the interior of the casing and upward through the annulus. Once the cement slurry has filled the annular interval to be cemented, the pumping is stopped and the cement is allowed to set.

It is important for the cement to form a strong, continuous sheath which bonds the casing to the wall of the wellbore. The cement should completely surround the circumference of the casing and should extend uniformly through the vertical length of the annular interval cemented. If the cement is weak, or if any voids are left therein, several undesirable consequences can result. A poor cementing job will not effectively segregate the formations penetrated by the wellbore, and unwanted communication between the formations may occur, sometimes resulting in the production of unwanted fluids. Also, production fluid from a petroleum bearing formation may flow through channels in the cement and into another formation, where it is lost. This is especially disadvantageous when the other formation contains an aquifer. Contamination of the petroleum bearing formation itself can also occur, such as when salt water channels through the cement and flows into the petroleum bearing formation. Another deleterious consequence of a poor cementing job can be the loss of treatment fluids which are pumped down the well to stimulate production.

One of the most common causes of ineffective cementing jobs is the failure to displace all of the drilling mud and filter cake from the annulus prior to introduction of the cement slurry. Filter cake is a layer of solids concentrated from the drilling mud, which most commonly builds up on the wall of the wellbore opposite permeable formations. Even relatively small amounts of drilling mud and filter cake can contaminate the cement slurry and cause weak spots in the cement. Large quantities can obstruct the flow of the cement slurry and thus prevent the cement slurry from completely surrounding the casing, thereby resulting in channels through the cement.

A great deal of effort has gone into developing methods and apparatus for effectively removing drilling mud and filter cake from the annulus so that the cement slurry will not be obstructed or contaminated. Numerous preflush fluids have been developed, some with thickening agents, which are pumped through the annulus ahead of the cement slurry in an attempt to flush drilling mud and filter cake out of the annulus. Alteration of the properties of the cement slurry itself has also been tested. One common practice is to use centralizers and scratchers on the casing to scrape filter cake from the wall of the wellbore as the casing string is lowered into place. Although these methods and apparatus having provided some benefit, ineffective cementing jobs caused by incomplete displacement of drilling mud and filter cake are still common. When this occurs, expensive remedial cementing is often required, which carries with it the additional cost of the revenues lost while the well is shut in for the remedial work.

There still exists a great need in the art for a method of cementing wells which will prevent drilling mud and filter cake from causing weak spots and channels in the cement. The present invention is aimed at providing such a method.

SUMMARY OF THE INVENTION

The present invention is a method for cementing wells, wherein a fluid is oscillated in the annulus prior to cementing. The direction of flow of the fluid in the annulus is changed at least twice. The oscillatory flow of the fluid removes gelled drilling mud and filter cake more effectively than conventional unidirectional flow. The cement slurry is then pumped into the annulus, displacing the fluid, and the cement is allowed to set.

BRIEF DESCRIPTION OF THE DRAWINGS

FIG. 2 is a sectional side view of a selective check valve which can be used in practicing the method of the present invention. The selective check valve is shown in an open position.

FIG. 3 is a sectional side view showing the selective check valve in a closed position, with cement slurry therein.

DESCRIPTION OF THE PREFERRED EMBODIMENTS

Figure 1:
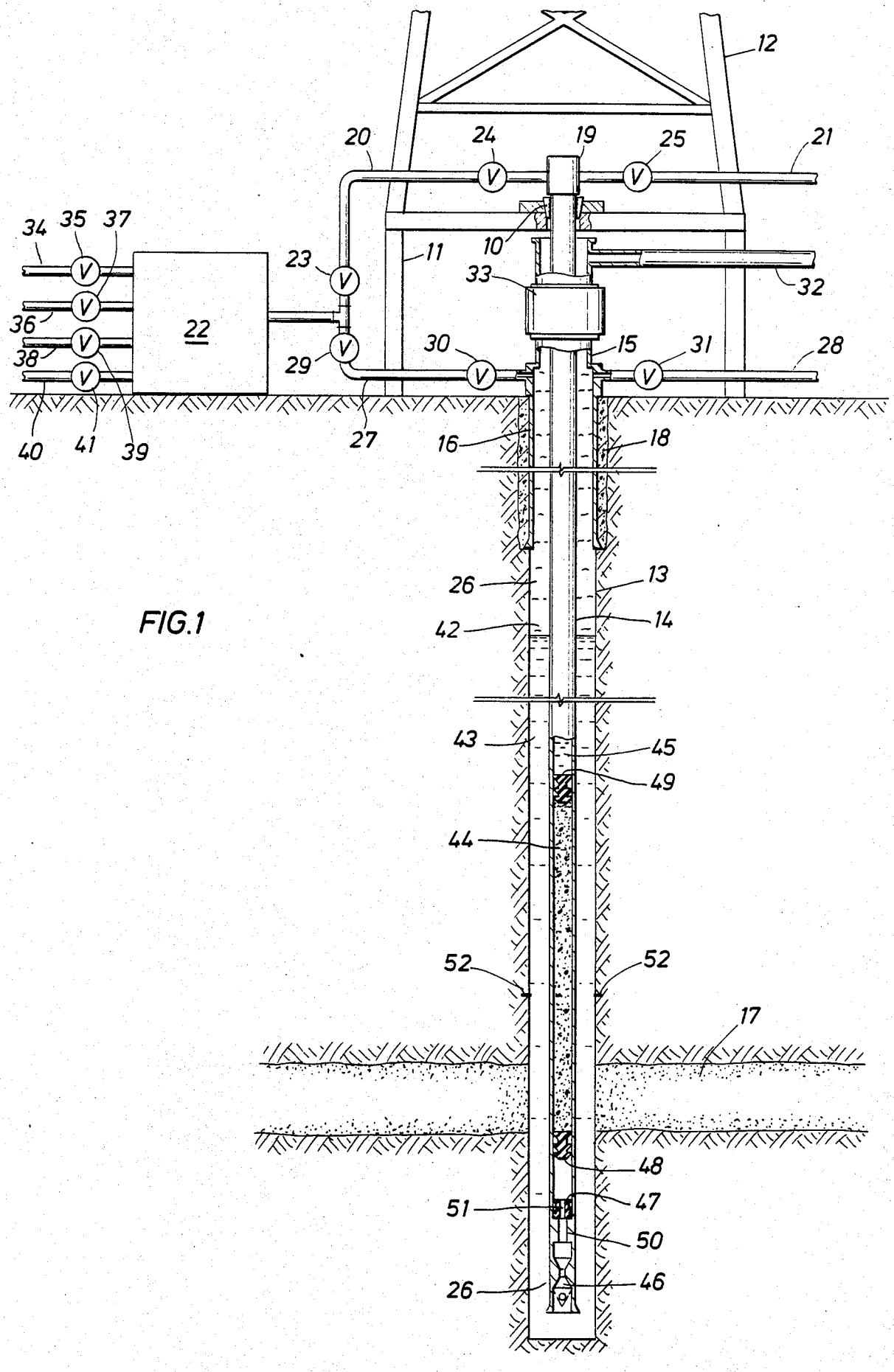
FIG. 1 is a side view, partly in section, of a wellbore and equipment for practicing the method of the present invention.

The present invention is an oscillatory flow method for cementing casing in wellbores. The term oscillatory flow refers to changing the direction of flow of fluid in the annulus prior to introduction of a cement slurry into the annular interval to be cemented. This is to be contrasted with conventional cementing methods, wherein the flow of fluid in the annulus is unidirectional. By changing the flow of fluid in the annulus from a forward direction to a reverse direction or vice versa, more drilling mud and filter cake can be displaced, out of the annulus so as not to contaminate or obstruct the cement slurry which follows. Flow in the forward direction refers to flow down the interior of the casing and up the annulus. Flow in the reverse direction refers to flow down the annulus and up the casing.

Referring to FIG. 1, apparatus for practicing the method of the present invention can be seen. Rig platform 11 and mast 12 are located on the surface over wellbore 13. The wellbore has been drilled to a desired depth and the drill string (not shown) has been removed. Casing 14 has been lowered into the wellbore and is held in position, suspended above the bottom of the wellbore, by slips 10 in the rig platform. The casing passes through wellhead 15. The casing illustrated is production casing which extends from the surface through surface casing 16 to petroleum bearing formation 17. The surface casing has already been cemented in place by cement 18. Although the cementing of production casing is used to illustrate the method of the present invention, it is to be understood that the method can also be used to cement casing other than production casing, such as surface casing 16 or intermediate casing (not shown).

In addition to wellhead 15, other surface equipment is employed. Cementing head 19 provides fluid communication between the interior of the casing and lines 20 and 21. Line 20 leads to pump unit 22 and is controlled by valves 23 and 24. Line 21 leads to fluid collection pits (not shown). Valve 25 controls flow through line 21.

Three lines provide fluid communication with annulus 26. Two of these lines, line 27 and line 28, connect to the wellhead. Alternatively, lines 27 and 28 can be connected to spools in the blowout preventer stack (not shown). Line 27 leads to pump unit 22 and is controlled by valves 29 and 30. Line 28 is regulated by valve 31 and leads to the fluid collection pits (not shown). The third line communicating with the annulus is mud-return line 32, through which drilling mud flows from the annulus to a shale shaker (not shown) and mud tanks (not shown). The drilling mud is recirculated from the mud tanks to the pump unit. Annular blow out preventer 33 functions to seal off the annulus from the mud-return line.

Mud from the mud tanks is available to pump unit 22 via line 34, which is controlled by valve 35. There are three other lines leading to the pump unit. Line 36 carries preflush fluid and is controlled by valve 37, line 38 carries cement slurry and is controlled by valve 39, and line 40 carries displacement fluid and is controlled by valve 41. The tanks which contain the preflush fluid, cement slurry and displacement fluid are not shown.

FIG. 1 shows the casing and annulus as being full of drilling mud 42, preflush fluid 43, cement slurry 44 and displacement fluid 45. At the stage illustrated, the oscillatory phase of the method is in progress. Prior to describing the oscillatory phase however, it is necessary to describe how the drilling mud, preflush fluid, cement slurry and displacement fluid were introduced into the casing and annulus. In the description which follows, all of the valves and the annular preventer are in a closed position unless otherwise stated.

When the casing string is made up and lowered into the wellbore, the wellbore is full of drilling mud from the drilling operation. The drilling mud is left in the wellbore after removal of the drill string in order to control the well. At the bottom of casing 14 is selective check valve 46 which permits the drilling mud to flow into the casing as the casing is lowered into the wellbore. The selective check valve permits all fluids to flow in the forward direction, but prevents cement slurry from flowing back into the casing after it has been introduced into the annulus. The selective check valve will be described in greater detail below. Since drilling mud flows into the casing through the selective check valve as the casing is lowered into the wellbore, the casing is initially full of drilling mud.

As is well known to those skilled in the art, the first step in preparing the annulus for cementing is called conditioning. Conditioning is necessary because drilling mud acquires a greater gel strength when allowed to sit for a period of time in a quiescent state. During the makeup and positioning of the casing string in the wellbore, the drilling mud is not circulated, and hence tends to gel. In the conditioning step, the drilling mud is circulated in an attempt to break the gel and thereby set as much of the drilling mud and filter cake into motion as possible. However, the conditioning step will not be able to set all of the drilling mud and filter cake in the annulus into motion, and hence some gelled drilling mud and filter cake will remain stationary.

Conditioning is accomplished by opening valves 23, 24, and 35 and annular preventer 33 and by switching on pump unit 22. This causes drilling mud to be pumped through line 20 and into casing 14. The drilling mud flows downward through the casing, through selective check valve 46, upward through annulus 26 and through mud-return line 32. After going through a shale shaker (not shown) and mud tank (not shown), the drilling mud is recycled to the pump unit through line 34. The drilling mud is circulated in this manner for a period of time sufficient to set most of the drilling mud in the annulus into motion. Rig mud pumps (not shown) can be used instead of pump unit 22 to circulate the drilling mud for conditioning.

When the conditioning step is completed, first bottom plug 47 is dropped into the casing through cementing head 19. Some cementing heads are equipped to automatically drop plugs into the casing when a switch is activated, but others require manual dropping, which necessitates that the pump unit be switched off. Bottom plug 47 is dropped into the casing to separate drilling mud 42 from preflush fluid 43, which is about to be introduced into the casing. By closing valve 35 and opening valve 37, the pump unit will draw preflush fluid from line 36 and will pump it through line 20 and into the casing. The dropping of the first bottom plug is coordinated with the closing of valve 35 and opening of valve 37 so that the first bottom plug separates the drilling mud from the preflush fluid.

Valve 37 is left open until a desired quantity of preflush fluid has been introduced to the casing. As is well known to those skilled in the art, preflush fluids are used to flush drilling mud and filter cake out the annulus before the cement slurry is introduced therein. The quantity of preflush fluid used depends on a number of factors, including the volume of the annular interval to be cemented and the geometry of the wellbore. In FIG. 1, the annular interval to be cemented extends from the bottom of the wellbore to the level marked by lines 52. A wide variety of preflush fluids are available; water is commonly employed. As used herein, preflush fluid means any fluid other than drilling mud which is pumped into the annulus prior to introduction of the cement slurry into the annular interval to be cemented. As the preflush fluid is pumped into the casing, the drilling mud is displaced downward through casing 14, upward through annulus 26 and out through mud-return line 32.

Once the desired quantity of preflush fluid has been introduced into the casing, second bottom plug 48 is dropped to separate the preflush fluid from the cement slurry. Next, valve 37 and annular preventer 33 are closed, and valves 31 and 39 are opened. This switches the pump unit from preflush fluid to cement slurry 44, which is drawn through line 38. As used herein, cement slurry means any material adapted to bond the casing to the wall of the wellbore. Portland cement slurries are most commonly used. The cement slurry is pumped through line 20 and into the casing behind the preflush fluid. This is continued until the desired quantity of cement slurry has been pumped into the casing. Naturally, the quantity of cement slurry used depends on the volume of the annular interval to be cemented. As the cement slurry is pumped into the casing, the preflush fluid and drilling mud are displaced ahead of it. Drilling mud is displaced upward through the annulus, out through line 28 and into the fluid collection pits (not shown). Due to the greater density of the cement slurry, it may be necessary to partially close valve 31 to slow the descent of the cement slurry in the casing.

Once the desired quantity of cement slurry has been introduced into the casing, the pump unit is switched off and lines 20 and 38 are washed to prevent cement from hardening therein. Top plug 49 is dropped into the casing to separate the cement slurry in the casing from the displacement fluid to follow. Valve 39 is closed and valve 41 is opened, and the pump unit is switched on. This causes the pump unit to draw displacement fluid from line 40 and pump it through line 20 and into the casing. Water or drilling mud are often used as displacement fluids. As the displacement fluid is pumped, the cement slurry, preflush fluid and drilling mud are displaced ahead of it.

Located just above selective check valve 46 near the bottom of the casing is landing collar 50. The landing collar provides a restriction in the interior of the casing through which the bottom plugs cannot pass. When the leading edge of the preflush fluid has been displaced to the bottom of the casing, first bottom plug 47 will seat on the landing collar. The continued application of pressure by the pump unit or by the weight of the cement slurry causes a diaphragm (not shown) in the first bottom plug to rupture. This creates opening 51 in the first bottom plug through which the preflush fluid can flow. Bottom plugs are well known to those skilled in the art. Although the use of two bottom plugs is preferred, one or both can be omitted.

In FIG. 1, the first bottom plug is shown as having already been ruptured, and the preflush fluid has been displaced out the bottom of the casing and upward through the annulus, pushing the drilling mud ahead of it. The preflush fluid is displaced by the pumping of the cement slurry and the displacement fluid, as described above, until the trailing edge of the preflush fluid and second bottom plug 48 are just above the first bottom plug and the landing collar. Thus, most of the preflush fluid is in the annulus, with a relatively small amount left in the casing. This is the point in time at which the oscillatory phase of the method of the present invention is commenced. This is also the point in time illustrated in FIG. 1.

In the oscillatory phase, the direction of flow of fluid in the casing and annulus is changed at least twice. In one embodiment, the direction of flow is changed at least four times. By changing the direction of flow of the preflush fluid in the annulus, more gelled drilling mud and filter cake will be displaced therefrom. To change the flow from the forward direction to the reverse direction, valves 23, 24, 31 and 41 are closed and valves 25, 29, 30 and 35 are opened. This causes drilling mud 42 to be pumped through line 27 and down the annulus. As a result, preflush fluid 43 changes direction and flows down the annulus, through the selective check valve and up the casing, thereby displacing cement slurry 44 and displacement fluid 45 upward in the casing. The quantity of drilling mud which should be pumped into the annulus depends primarily on the volume of the annular interval to be cemented. The quantity should not be so much as to displace the cement slurry all the way to the top of the casing.

Once the desired quantity of drilling mud has been pumped into the annulus to provide the reverse flow, the direction of flow is changed back to forward. This is accomplished by closing valves 25, 29, 30 and 35 and opening valves 23, 24, 31 and 41. By doing so, the pump unit stops pumping drilling mud down the annulus and starts pumping displacement fluid down the casing through line 20. If necessary, valve 31 can be partially closed to slow the flow of drilling mud 42 and preflush fluid 43 through line 28. This may be necessary due to the high density of the cement slurry. Displacement fluid is pumped into the casing until the trailing edge of the preflush fluid and second bottom plug 48 are again just above first bottom plug 47 and landing collar 50.

This completes one full cycle of oscillatory flow. The cycle is repeated if necessary a sufficient number of times to adequately clean the annulus of gelled drilling mud and filter cake. The cycle is repeated by closing valves 23, 24, 31 and 41 and opening valves 25, 29, 30 and 35 to achieve reverse flow and by closing valves 25, 29, 30 and 35 and opening valves 23, 24, 31 and 41 to achieve forward flow. With each change in the direction of flow, the preflush fluid should further clean the annulus.

Once the desired number of oscillatory flow cycles have been completed, cement slurry 44 is introduced into the annulus to cement the casing. With valves 25, 29, 30 and 35 closed and valves 23, 24, 31 and 41 open for flow in the forward direction, displacement fluid is pumped into the casing through line 20. As before, valve 31 can be partially closed to slow the rate of flow and thereby slow the rate of descent of cement slurry 44 in the casing. As the cement slurry descends, preflush fluid 43 and drilling mud 42 are displaced up the annulus and out line 28 into fluid collection pits (not shown). Alternatively, valve 31 can be kept closed and annular preventer 33 opened instead, so that the fluids displaced up the annulus will flow out mud-return line 32.

When second bottom plug 48 reaches first bottom plug 47, it will seat thereon. The first bottom plug is seated on landing collar 50. As pressure builds up in the casing from the pumping of displacement fluid, the diaphragm (not shown) in the second bottom plug will rupture. As a result, the cement slurry will be pumped downward through the second bottom plug, through the first bottom plug, through the landing collar and through selective check valve 46. This forces the cement slurry into the annulus, filling the annular interval to be cemented. Pumping is continued until top plug 49 seats on the second bottom plug. The top plug has no diaphragm and hence does not permit the displacement fluid to enter the annulus. When the top plug seats, an increase in pressure is detected at the surface and the pump unit is switched off. All circulation is thereby halted, and the cement slurry is allowed to set. This completes the cementing job.

Because of the high density of the cement slurry, it will have a tendency to flow back into the casing prior to setting. In conventional cementing methods, this is usually prevented by including a float collar at the bottom of the casing string. Float collars contain check valves which permit fluids to flow in the forward direction out of the casing and into the annulus, but which do not permit reverse flow. Such float collars are not suitable for use in the oscillatory flow method of the present invention because reverse flow is required. Selective check valve 46 is used instead. It permits forward and reverse flow of the drilling mud and preflush fluid, but permits the cement slurry to flow in the forward direction only. This keeps the cement slurry from flowing back into the casing after it is introduced into the annulus.

FIG. 2 shows a sectional side view of selective check valve 46. The selective check valve is a tubular member threaded onto the bottom of casing 14. Constriction 60 in the selective check valve serves as a seat for float 61, which is spherical in shape. Float basket 62 limits the downward travel of the float. The float basket is conical in shape, having its apex 63 at the lower end. The apex of the float basket is soid, while the frustrum has slots 64 which permit fluid to flow into and out of the selective check valve. Float 61 has a density less than the density of cement slurry, but greater than the density of drilling mud, preflush fluid and displacement fluid. The intermediate density of the float permits the selective check valve to discriminate between the cement slurry and the other fluids, thereby restricting reverse flow of the cement slurry only.

All fluids, including the cement slurry, can flow in a forward direction out of the casing, through the selective check valve and into annulus 26. During forward flow, the float rests in the apex of the float basket while fluid flows downward through constriction 60 and slots 64. During reverse flow, all fluids which are less dense than the float are permitted to flow upward through the slots and the constriction. The solid apex of the float basket shields the float from the upward force of the flowing fluid, thereby preventing the float from being pushed up against the constriction. This permits the preflush fluid to flow back up the casing during the reverse flow of the oscillatory phase as described above.

FIG. 3 shows the selective check valve full of cement slurry 44. As described above, the cement slurry is pumped through the selective check valve and into the annulus following the oscillatory phase. Because float 61 is less dense than the cement slurry, it floats upward and seats on constriction 60. This prevents the cement slurry from flowing out of the annulus and back into the casing. In the unintended event that displacement fluid bypasses the top plug and gets pumped into the annulus, the check valve will permit the displacement fluid to be forced out of the annulus and back up the casing by the weight of the cement slurry. The float, being less dense than the displacement fluid, will permit such reverse flow, but will stop reverse flow when the cement slurry reenters the selective check valve. Thus, the selective check valve permits reverse flow as desired, but prevents undesirable reverse flow of cement slurry back into the casing.

While preferred, the selective check valve described above is not the only flow control device suitable for use in practicing the method of the present invention. Whatever flow control device is used must permit forward and reverse flow of the fluid oscillated in the annulus, but should permit only forward flow of the cement slurry. Another suitable arrangement (not shown) would be the use of a latch-down top plug between the cement slurry and the displacement fluid. This type of device is well known to those skilled in the art. The latch-down top plug latches onto a lock plate near the bottom of the casing when the cement slurry has been pumped into the annulus. This prevents the cement slurry from flowing back into the casing. The lock plate used for securing the latch-down top plug should be adapted to permit the bottom plugs to pass through. Alternatively, the bottom plugs can be adapted so that the first bottom plug latches onto the lock plate, the second bottom plug latches onto the first bottom plug and the top plug latches onto the second bottom plug. This will prevent reverse flow of the cement slurry back into the casing.

Another device (not shown) which can be used in place of the selective check valve described above is a stage cementing collar. These devices are well known to those skilled in the art and have a sliding sleeve with ports therethrough which can be aligned with ports in the outer portion of the collar. When the ports are aligned, both forward and reverse flow are permitted. The stage cementing collar would initially be in the open position for oscillatory flow and for pumping cement slurry into the annulus. Bottom plugs made for use with stage cementing collars are adapted to pass through the stage cementing collar and are called bottom bypass plugs. The stage cementing collar is installed in the casing string above the landing collar. The bottom bypass plugs seat on the landing collar after passing through the stage cementing collar. To prevent reverse flow of cement slurry back into the casing, the sliding sleeve of the stage cementing collar is forced into the closed position by the downward urging of the top plug which separates the cement slurry from the displacement fluid. Unlike the bottom bypass plugs, the top plug does not pass through the stage cementing collar.

Another device (not shown) which can be used to control flow is a ball-actuated valve such as the Circulating Flexiflow Fill-Up Collar, Product No. 161-03 of the Bakerline Division of Baker International Corporation. This collar is installed near the bottom of the casing and permits both forward and reverse flow until a check ball is introduced into the collar. With the check ball in place, only forward flow is permitted. The ball is introduced into the collar by placing it in the cement slurry. As the cement slurry is pumped through the collar and into the annulus, the check ball is forced through a hole in a rubber diaphragm in the collar. The rubber diaphragm will not permit the ball to be forced back out of the collar. If the cement slurry starts to flow back into the casing, the check ball seats on the rubber diaphragm to seal off the flow. Another ball-actuated valve which can be used is the Fitrol Insert Valve, Product No. FY14 of B&W Incorporated.

Referring again to FIG. 1, it will be recalled that the oscillatory flow method described above specifies the pumping of drilling mud 42 through line 27 and into annulus 26 to achieve reverse flow. If the annular interval to be cemented extends for a long distance relative to the length of the wellbore, this may result in drilling mud being reintroduced into the interval. It should be readily apparent that reintroduction of drilling mud into the annular interval to be cemented may to some extent recontaminate the interval with filter cake and gelled drilling mud. For this reason, if conditions permit, it may be more desirable to displace all of the drilling mud from the annulus prior to commencing the oscillatory phase, and to achieve reverse flow by pumping preflush fluid 43 into the annulus through line 27, rather than by pumping drilling mud. However, conditions may not permit this, because a sufficient hydrostatic pressure needs to be maintained in the annulus at all times prior to setting of the cement in order to prevent blowouts. Preflush fluid is generally less dense than drilling mud, and hence may not provide sufficient hydrostatic pressure.

If conditions are such that the preflush fluid can provide sufficient hydrostatic pressure, it may be desirable to flush the drilling mud all the way out of the annulus and to achieve reverse flow by pumping preflush fluid down the annulus. In such a case, only preflush fluid will be in the annulus during the oscillatory phase. Two modifications to the steps described above are needed to accomplish this. First, the quantity of preflush fluid 43 pumped into the casing and annulus ahead of cement slurry 44 needs to be enough to displace all of drilling mud 42 out of the annulus through mud-return line 32. Second, rather than opening valve 35 during reverse flow, valve 35 is kept closed and valve 37 is opened instead. As a result, preflush fluid will be pumped into the annulus rather than drilling mud.

By having only preflush fluid in the annular interval to be cemented during the oscillatory phase, displacement of gelled drilling mud and filter cake should be maximized. However, this is not to say that the use of drilling mud to achieve oscillatory flow will be ineffective. Although reintroduction of drilling mud into the annular interval to be cemented may result in some recontamination of the interval with filter cake and gelled drilling mud, these contaminates should be readily flushed out by the preflush fluid during the forward flow which occurs as the cement slurry is pumped into the annulus. The drilling mud should be readily flushed out because very little will have had a chance to gel or form filter cake. The drilling mud will not gel because it is not left in a quiescent state for any substantial length of time during the oscillatory phase. The filter cake should be readily flushed out because very little will collect on the wall of the wellbore during the relatively short period of time that the drilling mud is in the annular interval to be cemented during the oscillatory phase.

Although oscillation of preflush fluid in the annular interval to be cemented is preferred, the oscillatory flow method of the present invention can also be employed using drilling mud. That is, the drilling mud itself can be oscillated in the annulus to loosen and flush out filter cake and gelled drilling mud. In this case, the preflush fluid will remain in the casing during the oscillatory phase. After the oscillatory phase, the preflush fluid is pumped in a forward direction through the annular interval ahead of the cement slurry to flush the drilling mud therefrom. Although use of a preflush fluid between the drilling mud and cement slurry is preferred, it can be omitted in the case where drilling mud is oscillated to clean the annulus. Even without use of a preflush fluid, oscillation of the drilling mud should be able to provide better cleaning of the annulus than conventional unidirectional flow methods which do not use preflush fluids. As will be described below, oscillatory flow has several distinct advantages over unidirectional flow, which explains this surprising result.

To practice the oscillatory flow method of the present invention using drilling mud, only a couple of modifications to the procedure described above are required. The steps for performing the oscillatory flow method using drilling mud are identical to the steps described above for the case where preflush fluid is used, except that the preflush fluid is not pumped into the annulus until after the oscillatory phase. Thus, after a sufficient quantity of displacement fluid has been introduced into the casing to displace preflush fluid 43 and first bottom plug 47 downward until just above landing collar 50, valves 23, 24, 31 and 41 are closed and valves 25, 29, 30 and 35 are opened. This initiates reverse flow by pumping drilling mud 42 downward into the annulus through line 27. To change the flow back to the forward direction, valves 25, 29, 30 and 35 are closed and valves 23, 24, 31 and 41 are opened. This causes the displacement fluid to be pumped downward into the casing, which causes the drilling mud to change direction and flow upward in the annulus. After the desired number of oscillatory flow cycles have been performed in this manner, forward flow is used to introduce preflush fluid 43 and cement slurry 44 into the annulus. When first bottom plug 47 reaches landing collar 50, it will seat thereon. The continued buildup of pressure from pump unit 22 ruptures a diaphragm (not shown) in first bottom plug 47 and the preflush fluid is forced through selective check valve 46 and into the annulus, displacing driling mud 42 ahead of it. Continued pumping causes second bottom plug 48 to seat on first bottom plug 47 and rupture, and cement slurry 44 is pumped through selective check valve 46 and into the annulus until top plug 49 seats on the landing collar. The pump unit is then switched off and the cement slurry is allowed to set.

In conventional cementing operations, the flow of drilling mud and preflush fluid is unidirectional. Typically, the flow is in the forward direction, that is, downward through the casing and upward through the annulus. Using conventional unidirectional flow, significant amounts of gelled drilling mud and filter cake are often bypassed and left in the annulus, thereby obstructing or contaminating the cement slurry as it is pumped into place. As discussed above, the end result can be an ineffective cementing job which requires remedial cementing to correct the situation. The bypassing of the gelled drilling mud and filter cake in conventional cementing operations means that the force exerted on the immobile gelled drilling mud and filter cake by the unidirectional flowing fluids was not sufficient to either erode this stationary material or to overcome the forces tending to hold the material in place.

The ability of the oscillatory flow method of the present invention to effectively displace gelled drilling mud and filter cake from the annulus appears to be attributable to several distinct advantages which oscillatory flow has over conventional unidirectional flow.

Consider the action of the flowing fluid, either drilling mud or preflush fluid, on the stationary gelled drilling mud and filter cake during conventional unidirectional flow. Since the flow is unidirectional, erosion of the stationary material by the flowing fluid will tend to streamline the material. Streamlining reduces the cross-sectional surface area of the stationary material on the side facing into the flow, and thus reduces the force exerted on the material by the flowing fluid. As a consequence of streamlining, the stationary material acquires a top-to-bottom asymmetry. The oscillatory flow method of the present invention takes advantage of this asymmetry. When the direction of flow of fluid in the annulus is changed, the fluid exerts pressure against the unstreamlined side of the stationary material. The unstreamlined side presents a larger cross-sectional surface area to the flowing fluid, and thus the flowing fluid exerts a greater force on stationary material, thereby enhancing erosion and displacement.

A second advantage of oscillatory flow over conventional unidirectional flow is that periodic changing of the direction of flow contributes to a fatigue-like failure of the stationary filter cake and gelled drilling mud. When materials are subjected to an oscillatory stress, they fail at a lower stress value then when subjected to a uniformly directed stress. Due to this phenomenon, the oscillatory flow method of the present invention permits the available pumping force to more readily cause the stationary material in the annulus to fail and thereby be displaced.

The oscillatory flow method has another advantage over conventional cementing operations which use undirectional forward flow. Gelled drilling mud and filter cake frequently have densities greater than the densities of the drilling mud and preflush fluid being used to displace them. The net gravitational force acting on the stationary material in the annulus is the weight of the material minus its bouyancy. Bouyancy is determined by the relative densities of the stationary material and the flowing fluid. If the stationary material is denser than the flowing fluid, then the net gravitational force acting on the material is downward. Since the unidirectional forward flow of conventional cementing operations causes the fluid to flow upward in the annulus, the upward force exerted on the stationary material by the flowing fluid is opposed by the downward net gravitational force. In contrast, with the oscillatory flow method of the present invention, the downward force exerted by the fluid on the stationary material during reverse flow is augmented by the downward net gravitational force. This increases the likelihood of overcoming the forces tending to hold the stationary filter cake and gelled drilling mud in place.

The oscillatory flow method of the present invention has a further advantage over conventional cementing methods. With conventional cementing methods, greater quantities of preflush fluid must be pumped through the annulus in order to increase the contact time between the preflush fluid and the gelled drilling mud and filter cake. With the oscillatory flow method, contact time can be increased merely by repeating the oscillatory cycle, without the need for using greater quantities of preflush fluid. This benefit is especially important if the volume of preflush fluid used is limited by cost or hydrostatic pressure considerations.

TEST RESULTS

Tests have been conducted to compare the effectiveness of the oscillatory flow method of the present invention with the effectiveness of conventional methods which employ unidirectional flow. Effectiveness was measured in terms of the displacement efficiency of the methods. Displacement efficiency is defined as the percentage of the volume of the annulus of the test apparatus which is filled with cement by the methods. The volume of the annulus not filled by cement is filled with undisplaced filter cake and gelled drilling mud.

The test apparatus included a 10 foot long cylinder of permeable consolidated sand with an inner diameter of 6½ inches, reinforced externally by a perforated pipe housing. The consolidated sand cylinder was prepared using a mixture of epoxy resin and sand, and was designed to simulate a permeable formation. This cylinder of consolidated sand with its perforated pipe housing was placed inside a filtrate jacket containing water, and was allowed to become saturated with the water. The filtrate jacket was enclosed in a heating jacket containing heating oil, which was used to elevate the temperature of the apparatus, thereby simulating downhole conditions. A 15 foot long section of steel casing with a 5 inch outer diameter was positioned in the cylinder of consolidated sand to form an annulus with a volume of approximately 7 gallons. The casing was centralized in the cylinder of sand to provide a radially symmetrical annulus between the casing and the sand.

In all the tests, drilling mud and cement slurry were used. Several of the tests also used preflush fluid. The drilling mud was a 16 pound per gallon mud. Each barrel of the drilling mud was comprised of the following: 29.30 gallons of fresh water, 409 pounds of barite, 15 pounds of bentonite, 4 pounds of liqnosulfonate, 0.25 pounds of carboxymethyl cellulose and 0.20 gallon of a 20% solution of sodium hydroxide. The cement slurry was a 16.8 pound per gallon slurry with each 1.01 cubic feet of the slurry containing the following: 94.00 pounds of API Class H portland cement, 3.91 gallons of fresh water, 0.50% retarder and 0.50% dispersent. The preflush fluid was fresh water.

Each test was begun by circulating the drilling mud down the casing and up the annulus for a period of one hour at a flow rate of 3 barrels per minute and a temperature of 180° F. This portion of the test was designed to simulate the circulation of drilling mud during drilling. Due to the permeability of the consolidated sand, filter cake formed in the annulus during this portion of the test. After one hour, circulation was stopped and the temperature was raised to 200° F. The drilling mud was left in the annulus in this hot, quiescent state for a period of about 24 hours to simulate the conditions existing in a wellbore prior to commencement of a cementing operation. Due to the quiescent state, the drilling mud became gelled. After the gelation period, circulation was resumed at a rate of 3 barrels per minute and 180° F. for a period of one hour to simulate the conditioning step of cementing operations.

Five tests (numbered 1 to 5) were performed to determine the displacement efficiency of conventional unidirectional flow of drilling mud in the annulus. In these tests, after the circulation of drilling mud for one hour to simulate conditioning, 420 to 840 gallons of cement slurry were pumped down the casing and up the annulus at a rate of 4 barrels per minute. The temperature was then raised to 230° F. and the cement slurry was allowed to cure for a period of at least 24 hours, thereby cementing the casing to the cylinder of consolidated sand. Together, the casing, cement and cylinder of consolidated sand with is perforated pipe housing are called the test section. Following the cure, the test section was removed from the test apparatus and was cut into seven sections to permit measurement of the displacement efficiency. The results for the individual tests are given in the table below. The average displacement efficiency for the five tests of unidirectional flow of drilling mud was 64.2%. This means that 64.2% of the annulus was filled with cement. The remaining 35.8% was filled with undisplaced filter cake and gelled drilling mud.

Two tests (numbered 6 and 7) were performed to test the displacement efficiency of oscillatory flow of drilling mud in the annulus. In these tests, after the circulation of drilling mud in the forward direction for one hour to simulate conditioning, the flow was changed to the reverse direction and 10 barrels of drilling mud were pumped down the annulus and up the casing. The direction of flow was then changed back to forward and 10 barrels of drilling mud were pumped down the casing and up the annulus. In test 7, the cycle was repeated once more by changing the direction of flow to reverse and then to forward, pumping 10 barrels of drilling mud in each direction. Thus, drilling mud was oscillated in the annulus for one complete cycle of oscillatory flow in test 6 and for two complete cycles in test 7. A flow rate of 4 barrels per minute was used during the oscillatory phase. After this oscillatory phase, 420 gallons of cement slurry were pumped down the casing and up the annulus at a rate of 4 barrels per minute. The temperature was then raised to 230° F., the cement slurry was allowed to cure for at least 24 hours and the test section was removed and cut into seven sections. Inspection of these sections revealed surprising displacement efficiencies of 83.8% for test 6 and 94.4% for test 7, for an average displacement efficiency of 89.1%. This compares very favorably with the 64.2% average of the unidirectional flow tests.

Tests were also conducted to compare unidirectional flow with oscillatory flow where a preflush fluid is used. Three tests (numbered 8 to 10) were performed using unidirectional flow of preflush fluid. These tests were performed in the same manner as the five tests described above for unidirectional flow of drilling mud, except that 10 to 50 barrels of preflush fluid were pumped down the casing and up the annulus at a rate of 4 barrels per minute after the conditioning step and before the introduction of the cement slurry into the annulus. These tests yielded an average displacement efficiency of 80.8% for unidirectional flow of preflush fluid. Due to the use of the preflush fluid, these results were much better than the 64.2% displacement efficiency which resulted in the five tests of unidirectional flow of drilling mud alone. However, despite the improvement brought about by the use of the preflush fluid, the displacement efficiency for unidirectional flow still fell short of the 89.1% displacement efficiency found for oscillatory flow of drilling mud alone.

Two tests (numbered 11 and 12) were conducted using oscillatory flow of a preflush fluid. These tests were identical to the two tests described above for oscillatory flow of drilling mud alone, except that 10 barrels of preflush fluid were pumped with each change in the direction of flow, rather than 10 barrels of drilling mud. Thus, preflush fluid was oscillated in the annulus for one complete cycle of oscillatory flow in test 11 and for two complete cycles in test 12. In test 11, a displacement efficiency of 94.5% was measured. In test 12, the displacement efficiency was 90.2%, thus yielding an average efficiency of 92.3%. This far exceeds the 80.8% efficiency found for unidirectional flow of preflush fluid, and even exceeds the 89.1% efficiency found for oscillatory flow of drilling mud alone. The following is a table containing the results of all of the tests discussed above:

| Test No. | Type of Flow and Fluid | Displacement Efficiency | Average Displacement Efficiency |
|---|---|---|---|
| 1 | Unidirectional/Drilling Mud | 60.1% | |
| 2 | Unidirectional/Drilling Mud | 63.9% | |
| 3 | Unidirectional/Drilling Mud | 76.8% | |
| 4 | Unidirectional/Drilling Mud | 71.8% | |
| 5 | Unidirectional/Drilling Mud | 47.9% | 64.2% |
| 6 | Oscillatory/Drilling Mud | 83.8% | |
| 7 | Oscillatory/Drilling Mud | 94.4% | 89.1% |
| 8 | Unidirectional/Preflush Fluid | 82.7% | |
| 9 | Unidirectional/Preflush Fluid | 84.6% | |
| 10 | Unidirectional/Preflush Fluid | 75.0% | 80.8% |
| 11 | Oscillatory/Preflush Fluid | 94.5% | |
| 12 | Oscillatory/Preflush Fluid | 90.2% | 92.3% |

These tests, which were carefully designed to simulate actual well cementing conditions, demonstrate that the oscillatory flow method of the present invention is superior to the unidirectional flow used in conventional cementing operations. Indeed, these tests show the surprising result that oscillatory flow of drilling mud without the use of a preflush fluid has a better displacement efficiency than unidirectional flow using a preflush fluid. By increasing displacement efficiency with the method of the present invention, more filter cake and gelled drilling mud can be displaced out of the annulus. As a consequence, there is less obstruction and contamination of the cement slurry, resulting in a strong, uniform sheath of cement surrounding the casing and bonding it to the wall of the wellbore. The problems associated with an ineffective cementing job such as communication between formations, production of unwanted formation fluids and loss of well treatment fluids are thus minimized by the method of the present invention, and therefore, fewer expensive remedial cementing jobs will be required.

Inasmuch as the present invention is subject to many variations, modifications and changes in detail, it is intended that all subject matter discussed above and shown in the accompanying drawings be interpreted as illustrative and not in a limiting sense. For example, the oscillatory phase can be performed prior to pumping the cement slurry into the casing. Such variations, modifications and changes in detail are included within the scope of this invention as defined by the following claims.

What is claimed is:

1. A method of cementing a wellbore having a casing extending longitudinally therein which provides an annulus between said casing and the wall of said wellbore, said method comprising:

(a) introducing a fluid into said annulus;

(b) causing said fluid to flow in said annulus;

(c) changing the direction of flow of said fluid at least twice;

(d) introducing a cement slurry into at least an interval of said annulus, thereby displacing said fluid from said interval; and (e) allowing said cement slurry to set.

2. The method of claim 1 wherein said fluid is drilling mud.

3. The method of claim 2 wherein said fluid is a preflush fluid.

4. The method of claim 3 wherein said annulus contains drilling mud prior to the introduction of said preflush fluid into said annulus, said drilling mud being at least partially displaced from said annulus by said preflush fluid.

5. The method of claim 1 wherein the direction of flow of said fluid is changed at least four times.

6. A method of cementing a wellbore having a casing extending longitudinally therein which provides an annulus between said casing and the wall of said wellbore, said annulus containing drilling mud, said method comprising:

(a) causing said drilling mud to flow in said annulus;
(b) changing the direction of flow of said drilling mud at least twice;
(c) introducing a cement slurry into at least an interval of said annulus, thereby displacing said drilling mud from said interval; and
(d) allowing said cement slurry to set.

7. The method of claim 6 wherein the direction of flow of said drilling mud is changed at least four times.

8. The method of claim 6 wherein a preflush fluid is introduced into said interval after step (b) and before step (c), said preflush fluid displacing said drilling mud from said interval and said preflush fluid being displaced from said interval during step (c).

9. A method of cementing a wellbore at a well site, said wellbore having a casing extending longitudinally therein which provides an annulus between said casing and the wall of said wellbore, said casing having an opening at its lower end which permits fluid communication between said annulus and the interior of said casing, said well site having means for circulating fluid downward through said casing and upward through said annulus and for circulating fluid downward through said annulus and upward through said casing, said casing and said annulus containing drilling mud, said method comprising:

(a) pumping a cement slurry downward through said casing, thereby displacing said drilling mud downward through said casing and upward through said annulus;
(b) pumping a displacement fluid downward through said casing, thereby displacing said cement slurry downward toward the lower end of said casing, and thereby displacing said drilling mud upward through said annulus;
(c) pumping drilling mud downward through said annulus, thereby causing said drilling mud in said annulus to change direction and flow downward through said annulus and upward through said casing;
(d) pumping displacement fluid downward through said casing, thereby causing said drilling mud to change direction and flow downward through said casing and upward through said annulus;
(e) repeating steps (c) and (d) a desired number of times in an alternating sequence;
(f) pumping a sufficient quantity of displacement fluid downward through said casing to cause said cement slurry to be displaced out of said casing and into at least an interval of said annulus, thereby displacing said drilling mud from said interval; and
(g) allowing said cement slurry to set.

10. The method of claim 9 wherein a preflush fluid is pumped into said casing before step (a), said preflush fluid being displaced out of said casing and through said interval during step (f).

11. The method of claim 9 wherein said drilling mud is circulated for conditioning prior to step (a).

12. A method of cementing a wellbore at a well site, said wellbore having a casing extending longitudinally therein which provides an annulus between said casing and the wall of said wellbore, said casing having an opening at its lower end which permits fluid communication between said annulus and the interior of said casing, said well site having means for circulating fluid downward through said casing and upward through said annulus and for circulating fluid downward through said annulus and upward through said casing, said casing and said annulus containing drilling mud, said method comprising:

(a) pumping a preflush fluid downward through said casing, thereby displacing said drilling mud downward through said casing and upward through said annulus;
(b) pumping a cement slurry downward through said casing, thereby displacing said preflush fluid downward through said casing and upward through said annulus;
(c) pumping a displacement fluid downward through said casing, thereby displacing said cement slurry downward toward the lower end of said casing, and thereby displacing said preflush fluid upward through said annulus;
(d) pumping drilling mud downward though said annulus, thereby causing said preflush fluid to change direction and flow downward through said annulus and upward through said casing;
(e) pumping displacement fluid downward through said casing, thereby causing said preflush fluid to change direction and flow downward through said casing and upward through said annulus;
(f) repeating steps (d) and (e) a desired number of times in an alternating sequence;
(g) pumping a sufficient quantity of displacement fluid downward through said casing to cause said cement slurry to be displaced out of said casing and into at least an interval of said annulus, thereby displacing said preflush fluid from said interval; and
(h) allowing said cement slurry to set.

13. The method of claim 12 wherein said drilling mud is circulated for conditioning prior to step (a).

* * * * *

UNITED STATES PATENT AND TRADEMARK OFFICE

CERTIFICATE OF CORRECTION

PATENT NO. : 4,548,271

DATED : October 22, 1985

INVENTOR(S) : Stuart R. Keller

It is certified that error appears in the above-identified patent and that said Letters Patent is hereby corrected as shown below:

In column 2, line 17 of the Patent, delete "having" and insert --have-- in its place;

In column 2, line 63 of the Patent, delete the comma after "displaced" and before "out";

In column 7, line 24 of the Patent, delete "soid" and insert --solid-- in its place;

In column 9, line 67 of the Patent, delete "not" after the word "do" and before "use"; and In column 10, line 31 of the Patent, delete "driling" and insert --drilling-- in its place.

Signed and Sealed this

*Twenty-third* Day of *September 1986*

[SEAL]

*Attest:*

*Attesting Officer*

DONALD J. QUIGG

*Commissioner of Patents and Trademarks*